United States Patent [19]

Bartolo et al.

[11] Patent Number: 4,687,891

[45] Date of Patent: Aug. 18, 1987

[54] FAST MANUAL CLOSING MECHANISM OF A MINIATURE CIRCUIT BREAKER

[75] Inventors: William Bartolo, Eybens; Patrick De Robertis, Vizille; Daniel Vanzetto, Claix, all of France

[73] Assignee: Merlin Gerin, Grenoble Cedex, France

[21] Appl. No.: 857,624

[22] Filed: Apr. 30, 1986

[30] Foreign Application Priority Data

May 13, 1985 [FR] France ..... 85 07343

[51] Int. Cl.[4] ..... H01H 9/20

[52] U.S. Cl. ..... 200/153 G; 200/74; 200/153 H; 335/191

[58] Field of Search ..... 200/153 SC, 153 G, 153 H, 200/70, 73, 74, 67 C, 329, 337, 327, 325; 74/106; 335/189, 190, 191

[56] References Cited

U.S. PATENT DOCUMENTS

| | | | |
|---|---|---|---|
| 1,754,585 | 4/1930 | Van Valkenburg | 200/70 |
| 2,150,013 | 3/1939 | Von Voorn | 200/74 |
| 2,923,788 | 2/1960 | Norden | 200/74 |
| 3,002,068 | 9/1961 | Maier | 200/153 G |
| 3,339,047 | 8/1967 | Rys et al. | 200/153 G |
| 3,872,273 | 3/1975 | Netzel | 200/153 G |
| 4,368,444 | 1/1983 | Preuss et al. | 200/153 G X |
| 4,392,036 | 7/1983 | Troebel et al. | 200/153 G X |
| 4,472,701 | 9/1984 | Bellows et al. | 200/153 G X |

FOREIGN PATENT DOCUMENTS

| | | |
|---|---|---|
| 716054 | 12/1931 | France . |
| 798188 | 5/1936 | France . |
| 2344950 | 10/1977 | France . |

*Primary Examiner*—Stephen Marcus
*Assistant Examiner*—Ernest G. Cusick
*Attorney, Agent, or Firm*—Parkhurst & Oliff

[57] ABSTRACT

The invention relates to a fast closing mechanism of a circuit breaker with an operating handle.

The mechanism comprises an energy storage spring disposed between the handle and an intermediate lever supporting a transmission rod. A retaining plate operates in conjunction with a pin of the handle to occupy either an active position locking the rod during loading of the spring, or a retracted position unlocking the rod allowing the spring to be released at the end of closing travel.

6 Claims, 6 Drawing Figures

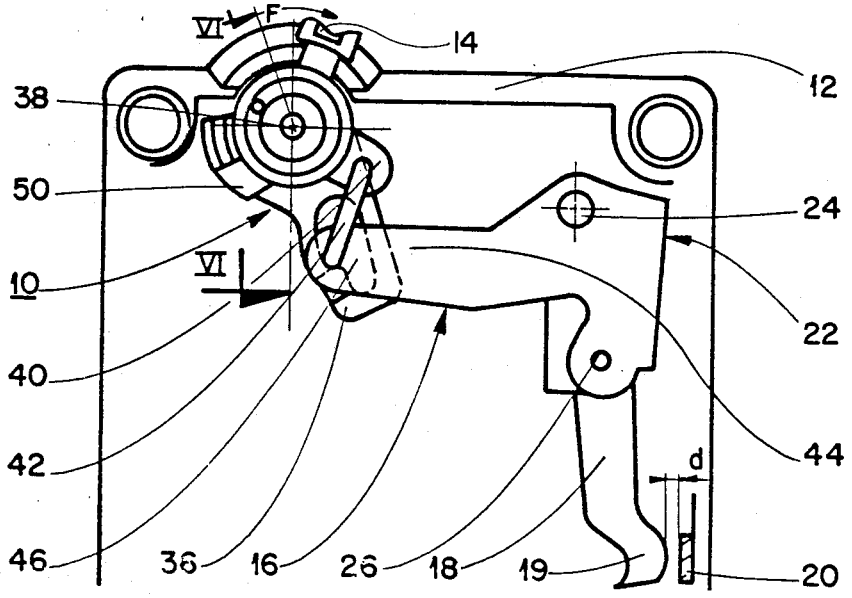
FIG. 3
FIG. 4
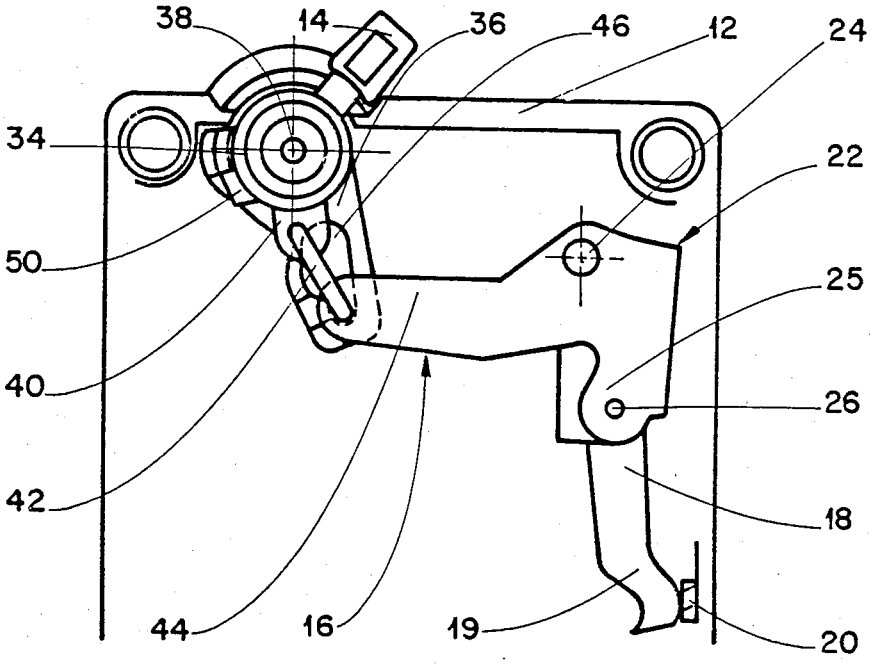

FAST MANUAL CLOSING MECHANISM OF A MINIATURE CIRCUIT BREAKER

BACKGROUND OF THE INVENTION

The invention relates to a fast manual closing mechanism of a moulded insulating casing miniature circuit breaker, comprising:

- a pivoting manual opening and closing operating handle, coupled by a kinematic linkage system to a contact arm,
- an energy storage spring disposed between an operating device and a transmission device of said kinematic linkage system,
- and a blocking device for blocking the transmission device during loading of the energy storage spring, neutralization of said blocking device taking place at the end of the closing travel allowing the spring to be released and the transmission device to move rapidly for fast closing of the contacts.

Fast closing mechanisms of the kind mentioned generally require interruption of the kinematic linkage system by means of ratchet lever systems designed to cooperate directly with the contact arm, during closing travel of the handle. These state-of-the-art mechanisms are complicated and their dimensions are incompatible with the small volume of the casing.

The object of the present invention is to achieve a simple mechanism for fast manual closing of the contacts of a current breaking switchgear device, the actuation of which requires a normal amount of force without excessive hangup when the energy storage spring comes into operation.

SUMMARY OF THE INVENTION

The mechanism according to the invention is characterized by the fact that the energy storage spring is anchored between the body of the handle and an intermediate lever articulated on a transmission rod to form a toggle joint coupled with said kinematic linkage system, and that the blocking device comprises:

- a retaining plate able to occupy either an active position locking the rod during loading of the energy storage spring, or a retracted position unlocking the rod allowing the dead point of said toggle joint to be passed, and the energy storage spring to be released,
- and an unlocking pin securedly united to the body of the handle, in such a way as to move the retaining plate from the active position to the retracted position, when the handle reaches a predetermined point of its trajectory situated at the end of closing travel.

It can be noted that all the parts indispensable for fast closing of the operating mechanism are located at the level of the handle. These can be added in the factory without any notable modifications to conventional mechanisms to transform a standard circuit breaker into a fast contact closing circuit breaker.

According to a feature of the invention, the retaining plate comprises a transmission rod guiding aperture, said aperture being fitted with an abutment acting as stop for the rod in the active position of the retaining plate. At the beginning of closing travel, the kinematic linkage system drives the contact arm to an intermediate position separated from the stationary contact by a clearance (d) of small thickness, said intermediate position of the contact arm corresponding to the latching position of the rod on the abutment of the aperture.

According to another feature of the invention, the retaining plate is pivotally mounted in a bearing of the casing and is biased towards the active position by a bias spring taking its bearing on a ledge situated opposite the bearing.

The energy storage spring is advantageously constituted by a torsion coil spring housed around the pivoting spindle of the handle in a cylindrical cavity of the body of the handle.

BRIEF DESCRIPTION OF THE DRAWINGS

Other advantages and characteristics will become more clearly apparent from the following description of an embodiment of the invention, given as an example only and represented by the accompanying drawings, in which:

FIGS. 1 to 4 are schematic elevation views of a fast closing mechanism according to the invention, shown respectively in the open position, during the closing movement before and after release of the transmission rod, and in the closed position of the contacts;

DESCRIPTION OF THE PREFERRED EMBODIMENT

Figure 1:
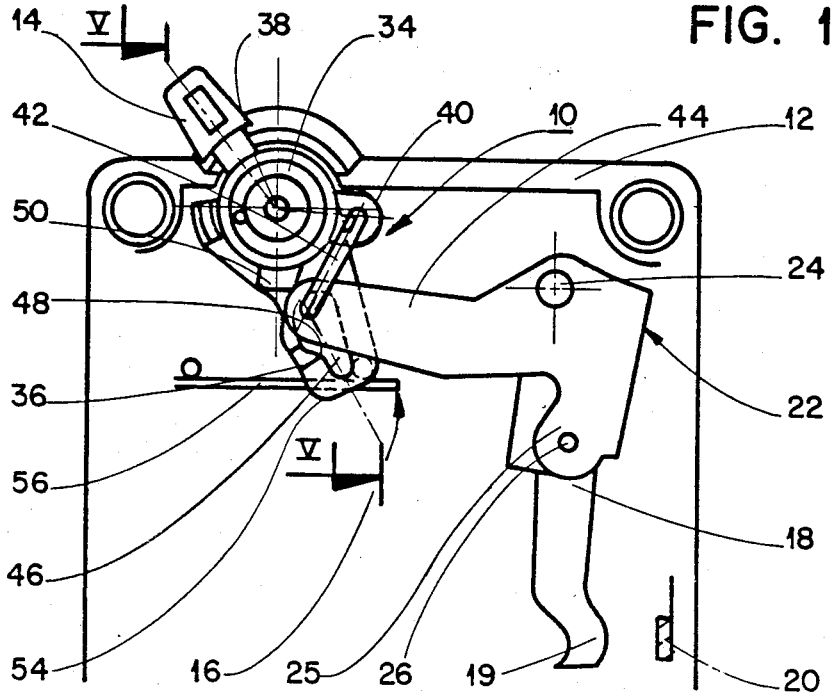
Figure 2:
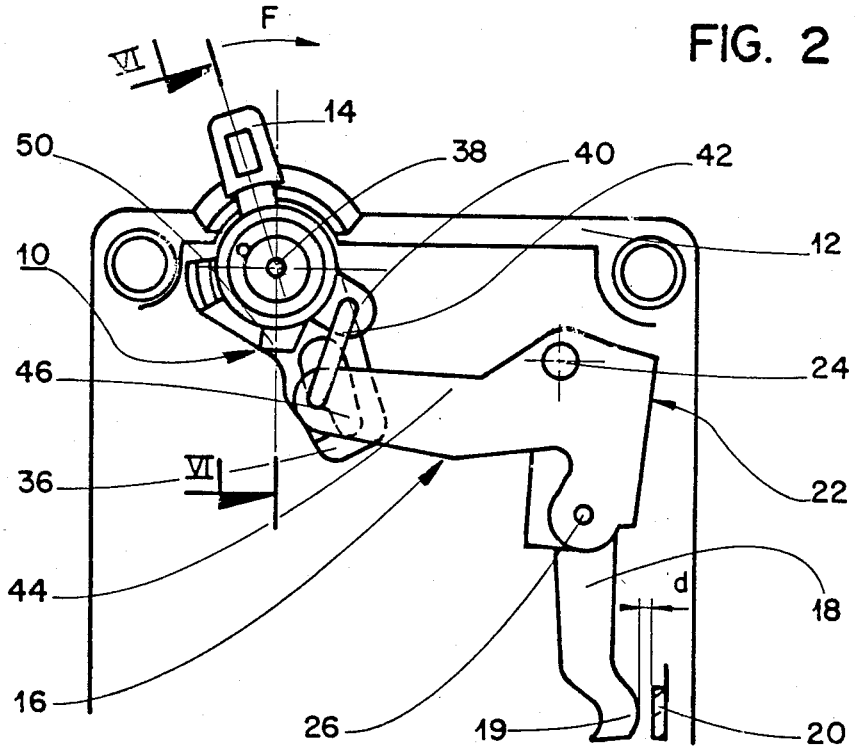

In the figures, a fast closing device 10 is incorporated in the operating mechanism of an electrical current switchgear device, notably a miniature low voltage circuit breaker with a moulded insulating casing 12. The mechanism of each pole comprises a pivoting manual operating handle 14 coupled by a kinematic linkage system 16 to a contact arm 18 bearing the moving contact 19, operating in conjunction with the stationary contact 20. The kinematic linkage system 16 of the mechanism is described in detail in French Pat. No. 2,344,950, but the mechanism tripping devices have not been represented in FIGS. 1 to 4.

The kinematic linkage system 16 comprises a rocker 22 pivotally mounted on a fixed spindle 24. One of the branches of the rocker 22 supports a pivot 26 on which the contact arm 18 is pivotally mounted, operating in conjunction with a latch stop belonging to the trip lever (not shown).

In the active position of the latch stop, the contact arm 18 is locked on the rocker 22, in such a way as to constitute a two-way link between the handle 14 and the contact arm 18. In the unlocked position of the latch stop, following tripping of the mechanism on a fault, the contact arm 18 is unlocked with respect to the rocker 22, resulting in the mechanical link between the handle 14 and the contact arm 18 being broken. An opening spring (not shown) then causes separation of the contacts 19, 20 independently from the handle 14. Operation of a mechanism of this kind is well known to those skilled in the art, and it is pointless describing it more fully here.

According to the invention, the fast closing device 10 comprises an energy storage spring 30 housed in a cylindrical cavity 32 of the body 34 of the handle 14, and a retaining plate 36, operating in conjunction with the kinematic linkage system 16 of the mechanism. The pivoting handle 14 is rotatingly mounted between two extreme closing and opening positions on a fixed transverse spindle 38 positioned in the aligned bearings of the casing 12. The energy storage spring 30 comprises a torsion coil spring extending in the cavity 32 coaxially around the spindle 38. One of the ends 31 of the storage spring 30 is engaged in a slot on the body 34 of the handle 14, whereas the opposite end 33 is securedly united to an intermediate lever 40 supporting a transmission rod 42. The branch 44 of the rocker 22 located opposite from the pivot 26 is latched to the rod 42, formed by a U-shaped bracket.

One of the arms of the transmission rod 42 is articulated on the lever 40, pivotally mounted on the spindle 38, and the other arm is guided inside an aperture 46 in the retaining plate 36. The transmission rod 42 and the intermediate lever 40 make up a toggle joint disposed between the handle 14 and the rocker 22.

Figure 5:
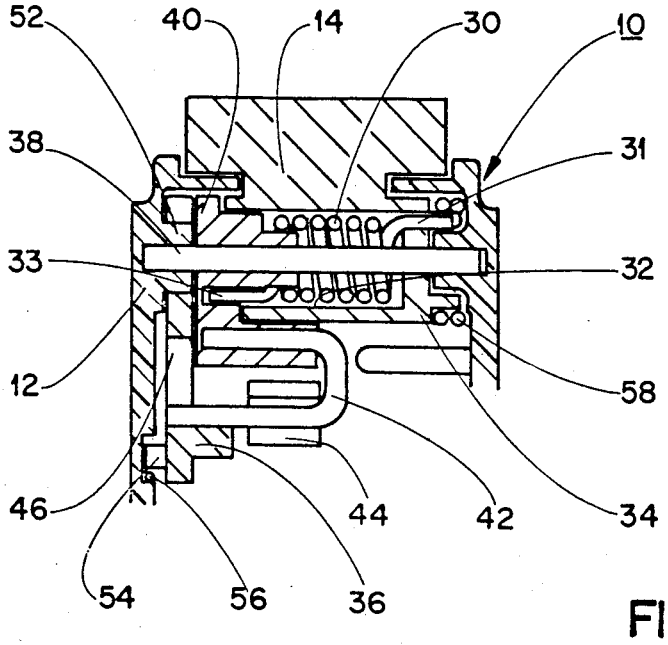
FIG. 5 shows a transverse cross-sectional view along the line V—V of FIG. 1.
Figure 6:
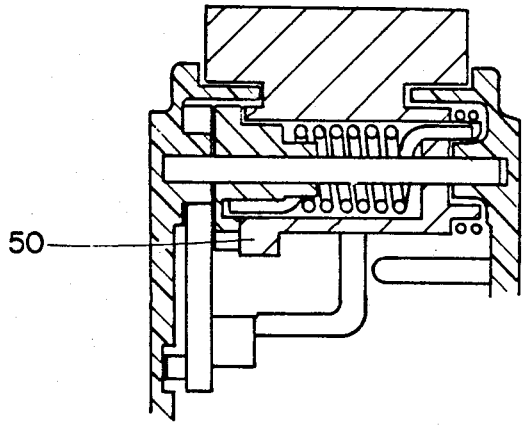
FIG. 6 is another cross-sectional view along the line VI—VI of FIG. 2.

The aperture 46 of the retaining plate 36 is fitted with an abutment 48, disposed in such a way as to form a retractable stop, operating in conjunction with the transmission rod 42. The body 34 of the handle 14 is fitted with an unlocking pin 50 moving according to a circular trajectory, when pivoting of the handle 14 occurs. The retaining plate 36 is mounted with limited pivoting on a shoulder or bearing 52 of the casing 12 in such a way as to occupy an active locking position or a retracted unlocking position. Opposite the bearing 52, the retaining plate 36 has a ledge 54 operating in conjunction with a bias spring 56 which biases the plate 36 counterclockwise to the active position, allowing the rod 42 to come up against the abutment 48 (FIG. 2) when a closing operation of the handle 14 takes place. A mechanical abutment exists between the unlocking pin 50 and the retaining plate 36 when the handle 14 reaches a predetermined point in its trajectory at the end of its closing travel. The pin 50 of the body 34 moves the retaining plate 36 to the retracted position against the action of the bias spring 56, causing the toggle joint 40, 42 to be broken, when the handle 14 comes to the end of closing travel (FIG. 3). The bias spring 56 is advantageously formed by a strand of a tripping lock return spring. That is, one strand of the spring 56 cooperates with the trip latch (not shown), and the other strand (shown in FIGS. 1 and 5) cooperates with the retaining plate 36 of the closing mechanism. Thus, a single spring may be common for the trip latch and the retaining plate.

A return spring 58, disposed between the casing 12 and the body 34 opposite the lever 40 biases the handle 14 towards the opening position (FIG. 1). The fast closing device 10 presents a compact structure due to the coaxial arrangement of the energy storage spring 30, the lever 40 and the retaining plate 36 on the spindle 38 of the handle 14.

Operation of the fast closing device 10 according to the invention is as follows:

In the open position of the mechanism (FIG. 1), the retaining plate 36 is in the active locking position by the action of the bias spring 56, and the rod 42 is separated from the abutment 48 by a predetermined distance. At the beginning of the mechanism closing travel by clockwise pivoting of the handle 14, indicated by the arrow F in FIG. 2, the rod 42 moves in the aperture 46 until it presses up against the abutment 48 of the retaining plate 36. During this beginning of closing travel, the kinematic linkage system 16 drives the contact arm 18 counter-clockwise to a stable intermediate position separated from the stationary contact 20 by a small clearance "d" having a length of one or a few millimetres. This stable intermediate position of the contact arm 18 corresponds to the latching position of the rod 42 on the abutment 48.

Loading of the energy storage spring 30 takes place during the continued pivoting movement of the handle 14 to the position represented in FIG. 3. Blocking of the rod 42 by the retaining plate 36 prevents movement of the kinematic linkage system, and the contact arm 18 remains stationary in the intermediate position in FIG. 2. When the handle 14 reaches the position in FIG. 3, the unlocking pin 50 drives the retaining plate 36 clockwise to the retracted position, against the force of the spring 56. Releasing the rod 42 enables the dead point of the toggle joint to be passed, and the spring 30 to be released. All the energy stored in the latter, by actuation of the handle 14 is thus restored to the rocker 22 of the kinematic linkage system 16, bringing about fast closing of the contacts 19, 20 (FIG. 4).

The transmission rod 42 is then positioned at the bottom of the aperture 46, and the retaining plate 36 remains biased to the retracted position by the pin 50. The retraction of the abutment 48 then enables a manual opening operation of the circuit breaker to be carried out by pivoting the handle 14 counterclockwise to the position in FIG. 1.

We claim:

1. A fast manual closing mechanism of a moulded insulating casing electrical circuit-breaker, comprising:

a manual opening and closing operating handle having a body coupled by a kinematic linkage system to a contact arm, and being mounted pivotally on a spindle;

an energy storage spring anchored between said handle and an intermediate operating lever;

a transmission rod articulated on said operating lever so as to form a dead center toggle joint coupled with said kinematic linkage system;

a retaining plate able to occupy either an active position for locking the transmission rod during loading of the energy storage spring, or a retracted position for unlocking the rod to free said toggle joint and allow the energy storage spring to be released; and an unlocking pin fixed to the body of the handle in such a way as to move the retaining plate from the active position to the retractred position, when the handle reaches a predetermined point of its trajectory situated at the end of closing travel, said pin and plate forming a blocking device suitable to lock the kinematic linkage system during loading of said energy storage spring, and to free said system to bring about fast closing of the contacts of the circuit-breaker.

2. A fast manual closing mechanism according to claim 1, wherein the retaining plate is pivotally mounted in a bearing of the casing and cooperative with an opposite bias spring suitable to bias the plate towards the active position.

3. A fast manual closing mechanism according to claim 2, wherein the intermediate operating lever is cooxially mounted the pivoting handle and the retaining plate.

4. A fast manual closing mechanism according to claim 3, wherein the body of said handle is provided with a cylindrical cavity in which is housed coaxially said energy storage spring, the bearing of said retaining plate including a coaxial shoulder of the casing.

5. A fast manual closing mechanism according to claim 4, wherein the transmission rod comprises a U-shaped bracket latched to a rocker of the kinematic linkage system, the bracket having a first arm articulated on the intermediate lever, and, a second arm moving inside the aperture of the retaining plate.

6. A fast manual closing mechanism according to claim 1, wherein a guiding aperture is arranged in said retaining plate for cooperating with the transmission rod of said toggle joint, said aperture including an abutment acting as stop for the rod in the active position of the retaining plate, so that the kinematic linkage system drives the contact arm at the beginning of closing travel to an intermediate position separated from the stationary contact by a clearance (d) of small thickness, said intermediate position corresponding to the latching position of the rod on the abutment of the guiding aperture.

* * * * *